US012805679B2

(12) United States Patent
Lächner et al.

(10) Patent No.: US 12,805,679 B2
(45) **Date of Patent: *Nov. 24, 2026**

(54) COUPLING SYSTEM FOR A SUCTION APPARATUS HAVING MUTUALLY ORIENTED ELECTRICAL PLUG-IN UNITS AND GUIDE CONTOURS, COUPLING ELEMENTS, SUCTION AIR-GUIDING COMPONENT AND SUCTION APPARATUS

(71) Applicant: BSH Hausgeräte GmbH, Munich (DE)

(72) Inventors: Peter Lächner, Bad Neustadt (DE); Konrad Osowski, Rzeszow (PL); Mateusz Zawilo, Trzebownisko (PL); Kamil Siewierski, Pstragowa (PL)

(73) Assignee: BSH Hausgeräte GmbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 19/093,593

(22) Filed: Mar. 28, 2025

(65) Prior Publication Data

US 2025/0302256 A1 Oct. 2, 2025

(30) Foreign Application Priority Data

Mar. 28, 2024 (DE) ..... 10 2024 203 010.4

(51) Int. Cl.

| | |
|---|---|
| ***A47L 9/24*** | (2006.01) |
| ***A47L 5/22*** | (2006.01) |
| *A47L 9/28* | (2006.01) |

(52) U.S. Cl.

CPC ..... *A47L 9/242* (2013.01); *A47L 5/22* (2013.01); *A47L 9/248* (2013.01); *A47L 9/2894* (2013.01)

(58) Field of Classification Search

CPC . A47L 9/242; A47L 5/22; A47L 9/248; A47L 9/2894; A47L 9/246

See application file for complete search history.

(56) References Cited

U.S. PATENT DOCUMENTS

| | | | | |
|---|---|---|---|---|
| 4,188,081 A * | 2/1980 | Holden | ..... | H01R 13/005 439/192 |
| 11,766,159 B2 * | 9/2023 | Lee | ..... | A47L 9/02 15/329 |

(Continued)

FOREIGN PATENT DOCUMENTS

| | | |
|---|---|---|
| DE | 202006013407 U1 | 11/2006 |
| DE | 202023104457 U1 | 8/2023 |

(Continued)

*Primary Examiner* — James M Hewitt, II

(74) *Attorney, Agent, or Firm* — Laurence. A. Greenberg; Werner H. Stemer; Ralph E. Locher

(57) ABSTRACT

A coupling system for connecting different suction air-guiding components of a suction apparatus includes a first coupling element having a tubular connecting piece and a second coupling element having a tubular receiving region for the connecting piece. The first coupling element includes a first plug-in unit and the second coupling element includes a second plug-in unit, which is configured so as to form an electrically conductive plug-in connection with the first plug-in unit of the first coupling element. The connecting piece has a guide contour that faces the first plug-in unit, and the second coupling element has a guide contour that is complementary thereto and that faces the second plug-in unit. A first coupling element and a second coupling element for a coupling system, as well as a suction air-guiding component for a suction apparatus and a suction apparatus, are also provided.

7 Claims, 9 Drawing Sheets

(56) References Cited

U.S. PATENT DOCUMENTS

| | | | | |
|---|---|---|---|---|
| 2015/0297045 | A1* | 10/2015 | Marsh | A47L 5/225<br>15/246.2 |
| 2020/0069131 | A1 | 3/2020 | Jung et al. | |
| 2022/0040838 | A1* | 2/2022 | Tulodziecki | B24B 41/00 |
| 2025/0235062 | A1* | 7/2025 | Grab | A47L 9/242 |

FOREIGN PATENT DOCUMENTS

| | | | |
|---|---|---|---|
| WO | 2011132366 | A1 | 10/2011 |
| WO | 2021215876 | A1 | 10/2021 |

* cited by examiner

COUPLING SYSTEM FOR A SUCTION APPARATUS HAVING MUTUALLY ORIENTED ELECTRICAL PLUG-IN UNITS AND GUIDE CONTOURS, COUPLING ELEMENTS, SUCTION AIR-GUIDING COMPONENT AND SUCTION APPARATUS

CROSS-REFERENCE TO RELATED APPLICATION

This application claims the priority, under 35 U.S.C. § 119, of German Patent Application DE 10 2024 203 010.4, filed Mar. 28, 2024; the prior application is herewith incorporated by reference in its entirety.

FIELD AND BACKGROUND OF THE INVENTION

The invention relates to a suction apparatus, in particular a cordless and/or hand-guided vacuum cleaner, having a coupling system for connecting an accessory. The invention also relates to coupling elements for a coupling system and a suction air-guiding component.

A suction apparatus, in particular a hand-held vacuum cleaner, typically includes a suction unit that can be carried and guided by a user by hand. The suction unit has a fan that is operated by using electrical energy from an electrical energy storage device of the suction unit. The fan is configured so as to generate a suction air flow in order to suck dirt through the suction mouth of the suction unit into a collection container of the suction unit. The suction mouth of the suction unit is typically configured as a coupling element, via which in each case an accessory from a set of different accessories can be connected to the suction unit. Exemplary accessories are a suction tube, a floor suction nozzle, a brush suction nozzle, a crevice suction nozzle, a wiper suction nozzle, etc.

U.S. Publication No. 2020/0069131 A1 describes a vacuum cleaner having a suction tube. German Utility Model DE 20 2023 104 457 U1 describes an adaptor for a vacuum cleaner. International Publication WO 2011/132366 A1 describes a vacuum cleaner having a suction tube and an electrical connector.

SUMMARY OF THE INVENTION

It is accordingly an object of the invention to provide a coupling system for a suction apparatus having mutually oriented electrical plug-in units and guide contours, coupling elements, a suction air-guiding component and a suction apparatus, which overcome the hereinafore-mentioned disadvantages of the heretofore-known devices of this general type and which provide a particularly stable, robust and convenient coupling system for a suction apparatus.

The object is achieved in each case by the subjects of the individual independent claims. Advantageous forms of embodiment are defined in particular in the dependent claims, described in the following description or illustrated in the appended drawing.

With the foregoing and other objects in view there is provided, in accordance with one aspect of the invention, a coupling system for connecting different suction air-guiding components of a suction apparatus (in particular of a hand-guided and/or cordless vacuum cleaner). The coupling system includes a first coupling element and a second coupling element, which can be connected to one another in order to connect two components of the suction apparatus to one another. The first coupling element can be disposed, in particular fastened, on a first component and the second coupling element can be disposed, in particular fastened, on a second component. The first and the second components can be connected to one another by connecting, in particular by plugging together, the first and the second coupling elements. Exemplary components are a suction unit (having a fan and a separating unit, a suction tube, a floor nozzle, a wiper nozzle, etc.).

The first coupling element includes a tubular connecting piece which protrudes in relation to the contact surface of the first coupling element along a longitudinal axis of the coupling system (for example by 5 cm or more, or by 7 cm or more).

The second coupling element includes a (complementarily configured) tubular receiving region for the connecting piece of the first coupling element, which extends, starting from the contact surface of the second coupling element, along the longitudinal axis into the housing of the second coupling element. The connecting piece can be plugged into the receiving region along the longitudinal axis in order to connect the first and the second coupling element to one another. In this case, the contact surfaces of the two coupling elements bear against one another when the two coupling elements are connected to one another. Suction air can then be conveyed through the receiving region and through the connecting piece. The connecting piece of the first coupling element and the receiving region of the second coupling element can thus be used to lengthen the tubular channel for the suction air flow of the suction apparatus.

The suction unit of the suction apparatus can have an electrical energy storage device for providing electrical energy for operating the fan of the suction apparatus. Furthermore, a component that is coupled to the suction unit can include an electrically operated actuator (for example, an electric motor) that is operated using electrical energy from the energy storage device. Alternatively or additionally, the coupled component can include a sensor for detecting sensor data. The coupling system can be configured so as to transmit electrical energy for operating the actuator and/or the sensor and/or data for controlling the actuator and/or sensor data of the sensor.

The first coupling element includes at least one first plug-in unit which is disposed along the transverse axis next to the connecting piece. The first plug-in unit can be configured as a jack.

The transverse axis of the coupling system is preferably disposed perpendicular to the longitudinal axis. The coupling system can further have a vertical axis that is disposed perpendicular to the transverse axis and to the longitudinal axis. The longitudinal axis, the transverse axis and the vertical axis can correspond to the axes of a three-dimensional Cartesian coordinate system. The point of origin of the coordinate system can be disposed at a center point of the coupling system.

The second coupling element includes at least one second plug-in unit which is disposed along the transverse axis next to the receiving region and which is configured so as to form an electrically conductive plug-in connection with the first plug-in unit of the first coupling element. When the first and the second coupling element are moved towards one another along the longitudinal axis in order to plug the connecting piece into the receiving region, the plug-in connection between the first and the second plug-in unit can be achieved by the same movement. The second plug-in unit can be configured as a plug-in connector.

The second plug-in unit has a protective wall which protrudes in relation to the contact surface of the second coupling element along the longitudinal axis (for example by 5 mm or more, in particular by 7 mm or in particular by 10 mm or more). The protective wall can thus extend, starting from the contact surface of the second coupling element, towards the contact surface of the first coupling element. The electrically conductive plug-in connection can be configured for the transmission of electrical energy or for the transmission of data.

The connecting piece of the first coupling element has a guide contour. The guide contour can extend along the longitudinal axis on the outer wall of the connecting piece (and can thus be disposed parallel to the longitudinal axis). Furthermore, the guide contour on the connecting piece of the first coupling element preferably faces the first plug-in unit. The connecting piece can, for example, be divided into two halves, in particular into an upper half and a lower half, by a bisecting plane that corresponds to the plane that is spanned by the longitudinal axis and by the transverse axis. The guide contour of the connecting piece can be disposed (completely) within the bisecting plane.

The second coupling element includes a guide contour which is configured so as to be complementary to the guide contour of the connecting piece and which, starting at the protective wall of the second plug-in unit, extends along the longitudinal axis into the receiving region. The guide contour of the second coupling element can be disposed (completely) within the bisecting plane of the receiving region. The guide contour of the second coupling element can in particular extend, starting from the end face of the protective wall of the second plug-in unit that faces away from the contact surface of the second coupling element, along the longitudinal axis into the receiving region. The guide contour can extend into the receiving region, for example, by 2 cm or more, in particular by 5 cm or more.

The guide contour of the second coupling element can thus already begin at the protruding protective wall, in particular at the end face of the protruding protective wall, of the second plug-in unit. Furthermore, the guide contour can extend along (and parallel to) the longitudinal axis into the receiving region of the second coupling element. A relatively long guide contour can thus be provided.

The guide contours can be configured so as to interact in such a manner that the guide contours block a rotation of the first coupling element relative to the second coupling element about the longitudinal axis (as an axis of rotation); Alternatively or additionally, the interaction of the guide contours can provide guidance for the plugging together of the two coupling elements along the longitudinal axis.

A coupling system is thus described, which has guide contours that have a particularly long length along the longitudinal axis. In this manner, it is possible to reliably prevent a relative movement of the coupling elements of the coupling system that are coupled to one another. In addition, a particularly reliable transmission of forces and/or (bending) torques via the coupling system can be achieved.

The guide contours can each have an edge region that faces the edge region of the respective other guide contour during a plug-in procedure along the longitudinal axis (for plugging the two coupling elements together). The edge regions can each correspond to a beginning of the respective guide contour. The edge region of at least one guide contour can have a reduced width (for example, in the case of a rib) or an increased width (for example, in the case of a groove) transverse to the longitudinal axis and/or transverse to the transverse axis and/or along the vertical axis, due to which threading of the guide contours along the longitudinal axis is assisted in the plug-in procedure. The width can be changed, for example, by 10% or more, in particular by 20% or more, in relation to the width outside the edge region. The change in the width can be achieved smoothly along the longitudinal axis. In this manner, the two coupling elements can be plugged together in a particularly convenient and reliable manner.

The guide contours of the first coupling element and of the second coupling element can form a tongue-and-groove connection which extends along the longitudinal axis from the protective wall, in particular from the end face of the protective wall, along the second plug-in unit (and in parallel thereto) of the longitudinal axis into the receiving region. In particular, the guide contour of the first coupling element can include a guide rib that is disposed on the outer wall of the connecting piece and that extends along (and in parallel to) the longitudinal axis. On the other hand, the guide contour of the second coupling element can include a guide groove that runs in the protective wall of the second plug-in unit and in the inner wall of the receiving region and that extends along (and in parallel to) the longitudinal axis. In an alternative example, the guide contour of the first coupling element is configured as a guide groove and the guide contour of the second coupling element is configured as a guide rib.

By providing a tongue-and-groove connection, it is possible that a particularly reliable and robust connection of the two coupling elements can be achieved.

The first plug-in unit of the first coupling element can extend, starting from the contact surface of the first coupling element, into the housing of the first coupling element (for example by 5 mm or more, or by 7 mm or more). Alternatively or additionally, the first plug-in unit can have a recess having a wall that extends along the longitudinal axis starting from the contact surface of the first coupling element and that contacts the protective wall of the second plug-in unit when the electrically conductive plug-in connection is present between the first and the second plug-in unit.

The first plug-in unit can be configured, in particular, as a recessed basin that is sunk into the housing of the first coupling element, starting from the contact surface of the first coupling element. When the electrically conductive plug-in connection is present, the protective wall of the second plug-in unit of the second coupling element can rest against the wall of the first plug-in unit surrounding the basin.

The guide contour of the first coupling element preferably extends along the longitudinal axis into the recess, in particular by at least 2 mm into the recess. In this manner, the length of the guide contour along the longitudinal axis can be further increased, as a result of which the robustness and the stability of the connection between the coupling units are further increased.

The first plug-in unit of the first coupling unit can have two contact bolts which are disposed one behind the other or one above the other along the vertical axis. In a corresponding manner, the second plug-in unit of the second coupling unit can have two contact pins for contacting the two contact bolts of the first plug-in unit, which are disposed one behind the other or one above the other along the vertical axis. In this manner, a particularly reliable transmission of electrical energy and/or data can be achieved.

The second plug-in unit can have a separating wall that is disposed between the two contact pins. The separating wall can protrude (in a manner corresponding to the protective wall) in relation to the contact surface of the second coupling element. The end face of the separating wall can be disposed flush with the end width of the protective wall. In other words, the separating wall and the protective wall can have the same length along the longitudinal axis.

It is possible to provide an individual sheathing for the two contact pins due to the separating wall and the protective wall.

The guide contour of the second coupling element and the separating wall can be disposed at the same height in relation to the vertical axis. In this case, the separating wall can act as a mechanical support for a portion of the guide contour. In this manner, a particularly stable guide contour of the second coupling element can be provided.

The first plug-in unit of the first coupling element can have one or more clamping elements on the bottom of the recess (in particular of the basin), which are configured to clamp the separating wall (for example between two clamping elements) when the electrically conductive plug-in connection exists between the first plug-in unit and the second plug-in unit. By clamping the separating wall, the stability of the connection between the two coupling elements can be further improved.

The connecting piece has an end face that faces the receiving region of the second coupling element. The end face of the connecting piece is preferably configured obliquely in relation to the longitudinal axis, so that the end face of the connecting piece is spaced at different points by a different distance from the contact surface of the first coupling element. The end face of the connecting piece can be disposed, for example, in a plane that runs parallel to the transverse axis, but is inclined about the transverse axis, so that an oblique suction mouth results, which is typically advantageous for the operation of the suction apparatus.

The guide contour of the first coupling element preferably does not extend to the end face of the connecting piece, but ends at a certain distance along the longitudinal axis in front of the end face of the connecting piece. In this manner, the two coupling elements can be plugged together in a particularly convenient and reliable manner.

The guide contour of the first coupling element can in particular be spaced apart from the end face of the connecting piece in such a manner that during a plug-in procedure (for plugging the two coupling elements together) substantially simultaneously:

- the end face of the connecting piece begins to dip into the receiving region of the second coupling element; and
- the guide contours of the first coupling element and of the second coupling element begin to interact mechanically, in particular in order to block a rotation of the first coupling element relative to the second coupling element about the longitudinal axis.

Alternatively or additionally, the protective wall of the second plug-in unit can have a certain length, starting from the contact surface of the second coupling element. The specific distance of the guide contour of the first coupling element from the end face of the connecting piece, in particular from the point of the end face of the connecting piece that is furthest away from the contact surface of the first coupling element, and the specific length of the protective wall of the second plug-in unit (starting from the contact surface of the second coupling element) preferably deviate from one another by at most 20%, in particular by at most 10%.

A guide contour that is configured in this manner and a connecting piece that is configured in this manner make it possible to plug the two coupling elements together in a particularly reliable and convenient manner.

As already explained, the second plug-in unit of the second coupling element can include at least one electrically conductive contact pin. The protective wall of the second plug-in unit preferably extends along the longitudinal axis beyond the contact pin, in particular by 2 mm or more. The contact pin can, for example, protrude by a first length relative to the contact surface of the second coupling element, and the protective wall of the second plug-in unit can protrude by a second length relative to the contact surface of the second coupling element. The second length can be greater than the first length. The second length can be greater than the first length, in particular, by 2 mm or more. In this manner, a particularly robust coupling system can be provided.

The first coupling unit can have in each case a first plug-in unit along the transverse axis on both sides of the connecting piece. In a corresponding manner, the second coupling unit can in each case have a second plug-in unit along the transverse axis on both sides of the receiving region. The two first plug-in units and the two second plug-in units in each case in pairs can form an electrically conductive plug-in connection. One of the two electrically conductive plug-in connections can be configured for the transmission of electrical energy for operating an actuator (for example, an electric motor) and/or a sensor. The other electrically conductive plug-in connection can be configured for the transmission of data, in particular for the transmission of control data for the control of the actuator and/or for the transmission of sensor data. In this manner, it is possible to provide a coupling system for a suction apparatus having an extended range of functions. In addition, due to the spatial separation of data transmission and energy transmission (on opposite sides of the connecting piece or the receiving region) it is possible to achieve fault-free operation of the suction apparatus.

The two electrically conductive plug-in connections can be configured and/or coded in a mechanically different manner in such a way that incorrect plugging together of the first coupling element and the second coupling element, in particular in a manner rotated by 180°, is prevented. For example, a web can be disposed on the protective wall (precisely) of one of the two second plug-in units, which bar is pushed into a corresponding groove in the wall of the recess of the corresponding first plug-in unit when the electrically conductive plug-in connection is formed. The other second plug-in unit does not have this web, and the other first plug-in unit does not have this groove. In this manner, it is possible to provide a particularly convenient and reliable coupling system.

The connecting piece of the first coupling element can have in each case a guide contour along the transverse axis on both sides of the connecting piece. The two guide contours can each be disposed in the bisecting plane of the connecting piece.

In a corresponding manner, the second coupling element can in each case have a guide contour which is complementary thereto along the transverse axis on both sides of the receiving region and which in each case, starting at the protective wall (in particular starting at the end face of the protective wall) of the respective second plug-in unit, extends along the longitudinal axis into the receiving region. The two guide contours can each be disposed in the halving plane of the receiving region.

The guide contours can be configured in each case in pairs so as to interact in such a manner that the guide contours block a rotation of the first coupling element relative to the second coupling element about the longitudinal axis.

The provision of pairs of guide contours on both (opposite) sides of the connecting piece or the receiving region, a particularly robust and stable connection between the coupling elements can be achieved.

With the objects of the invention in view, there is also provided, in accordance with a further aspect, a first coupling element for the coupling system that is described in this document. In particular, a first coupling element is described, which comprises a tubular connecting piece, which protrudes in relation to the contact surface of the first coupling element along the longitudinal axis, and which is configured so as to be inserted into a tubular receiving region of the second coupling element of the coupling system, wherein the receiving region extends, starting from the contact surface of the second coupling element, along the longitudinal axis into the housing of the second coupling element.

The first coupling element can include at least one first plug-in unit which is disposed along the transverse axis next to the connecting piece and which is configured so as to form an electrically conductive plug-in connection with the second plug-in unit of the second coupling element, wherein the second plug-in unit of the second coupling element is disposed along the transverse axis next to the receiving region, and wherein the second plug-in unit of the second coupling element has a protective wall which protrudes along the longitudinal axis in relation to the contact surface of the second coupling element.

The connecting piece of the first coupling element has a guide contour that is disposed on the outer wall of the connecting piece and that faces the first plug-in unit. The guide contour of the first coupling element can be configured so as to interact with a complementary guide contour of the second coupling element in such a manner that the guide contours block a rotation of the first coupling element relative to the second coupling element about (around) the longitudinal axis. In this case, the guide contour of the second coupling element extends, starting at the protective wall of the second plug-in unit, along the longitudinal axis into the receiving region.

With the objects of the invention in view, there is furthermore provided, in accordance with a further aspect, a second coupling element for the coupling system that is described in this document. In particular, a second coupling element is described, which comprises a tubular receiving region for the connecting piece of the first coupling element of the coupling system. The receiving region extends, starting from the contact surface of the second coupling element, along the longitudinal axis into the housing of the second coupling element. The tubular connecting piece of the first coupling element protrudes in relation to the contact surface of the first coupling element along the longitudinal axis.

The second coupling element can include a second plug-in unit which is disposed along the transverse axis next to the receiving region and which is configured so as to form an electrically conductive plug-in connection with the first plug-in unit of the first coupling element and which has a protective wall which protrudes along the longitudinal axis in relation to the contact surface of the second coupling element. The first plug-in unit of the first coupling element can be disposed along the transverse axis next to the connecting piece.

The second coupling element has a guide contour which is configured so as to be complementary to the guide contour on the connecting piece of the first coupling element and which, starting at the protective wall of the second plug-in unit, extends along the longitudinal axis into the receiving region. The guide contour of the second coupling element can be configured so as to interact with the guide contour of the first coupling element in such a manner that the guide contours block a rotation of the first coupling element relative to the second coupling element about the longitudinal axis.

In accordance with a further aspect, a further coupling system is described for connecting different suction air-guiding components of a suction apparatus. It should be noted that the features described in this document (in particular the features described above) of a coupling system can also be used individually or in combination for this coupling system.

As already explained, the coupling system includes a first coupling element having a tubular connecting piece which protrudes in relation to the contact surface of the first coupling element along the longitudinal axis. Furthermore, the coupling system includes a second coupling element having a tubular receiving region for the connecting piece of the first coupling element, which extends, starting from the contact surface of the second coupling element, along the longitudinal axis into the housing of the second coupling element.

The first coupling element includes at least one first plug-in unit, which is disposed next to the connecting piece along the transverse axis, and the second coupling element includes at least one second plug-in unit which is disposed along the transverse axis next to the receiving region and which is configured so as to form an electrically conductive plug-in connection with the first plug-in unit of the first coupling element. The first coupling unit preferably includes in each case a first plug-in unit along the transverse axis on both sides of the connecting piece, and the second coupling unit preferably includes in each case a second plug-in unit along the transverse axis on both sides of the receiving region.

The connecting piece of the first coupling element has a guide contour that faces the first plug-in unit (along the transverse axis). The second coupling element has a guide contour that is complementary thereto and that faces the second plug-in unit (along the transverse axis). The connecting piece of the first coupling element preferably has in each case a guide contour along the transverse axis on both sides of the connecting piece. In addition, the second coupling element preferably has in each case a guide contour that is in each case complementary thereto along the transverse axis on both sides of the receiving region.

As already explained, the guide contours are preferably configured so as to interact in such a manner that the guide contours block a rotation of the first coupling element relative to the second coupling element about the longitudinal axis.

A coupling system is thus described, in which the complementary plug-in units and the complementary guide contours face each other along the transverse axis and are preferably disposed within a common plane. Such an arrangement makes it possible to provide a particularly compact and stable coupling system for a suction apparatus.

The first plug-in unit of the first coupling element and the second plug-in unit of the second coupling element preferably intersect the horizontal plane that is spanned by the transverse axis and by the longitudinal axis. Furthermore, the guide contours of the first coupling element and of the second coupling element preferably intersect this horizontal plane. The guide contours of the first coupling element and the second coupling element can each run in particular along the longitudinal axis and can be disposed substantially within the horizontal plane.

The plug-in units and the guide contours can thus be oriented (in particular symmetrically) in relation to a common horizontal plane. In this manner, the compactness and stability of the coupling system can be further improved.

The first plug-in unit of the first coupling element and the second plug-in unit of the second coupling element are preferably configured in each case in a symmetrically identical manner in relation to the horizontal plane. Furthermore, the guide contours of the first coupling element and of the second coupling element are preferably in each case configured in a symmetrically identical manner in relation to the horizontal plane.

In particular, the first plug-in units of the first coupling element and the second plug-in units of the second coupling element can in each case intersect the horizontal plane and in each case be configured in a symmetrically identical manner in relation to the horizontal plane. Furthermore, the guide contours of the first coupling element on both sides of the connecting piece and of the second coupling element on both sides of the receiving region can intersect the horizontal plane and in each case can be configured in a symmetrically identical manner in relation to the horizontal plane.

Such a symmetrical construction makes it possible to provide a particularly compact and stable coupling system for a suction apparatus.

As already explained, a first plug-in unit can in each case have two contact bolts, which are disposed one behind the other along the vertical axis, wherein the vertical axis preferably is perpendicular to the horizontal plane. In a corresponding manner, a second plug-in unit can have in each case two contact pins for contacting the two contact bolts of the first plug-in unit, which are disposed one behind the other along the vertical axis.

A contact bolt of the first plug-in unit and a corresponding contact pin of the second plug-in unit can be disposed on a first side, in particular on the upper side, of the horizontal plane, and the respective other contact bolt of the first plug-in unit and the corresponding contact pin of the second plug-in unit can be disposed on the opposite second side, in particular on the underside, of the horizontal plane. The horizontal plane can thus run between the contact pins or contact bolts of the plug-in units in order to provide a particularly compact and stable coupling system for a suction apparatus.

The first plug-in unit of the first coupling element and the second plug-in unit of the second coupling element in each case can have a specific total height along the vertical axis. The guide contours of the first coupling element and the second coupling element in relation to the vertical axis are preferably disposed centrally along the transverse axis next to the first plug-in unit of the first coupling element or next to the second plug-in unit of the second coupling element, in particular in such a manner that in each case the same proportion of the total height of the first plug-in unit of the first coupling element or the second plug-in unit of the second coupling element in relation to the vertical axis is disposed above and below the guide contours of the first coupling element and the second coupling element. As already explained, the compactness and stability of the coupling system can be further increased by such a symmetrical construction.

As already explained, the second plug-in unit of the second coupling element can have a protective wall which protrudes in relation to the contact surface of the second coupling element along the longitudinal axis. The guide contour of the second coupling element can include a guide groove that runs in the protective wall of the second plug-in unit and that extends along the longitudinal axis. The guide groove is preferably disposed centrally on the protective wall along the vertical axis.

The second plug-in unit of the second coupling element can furthermore have a separating wall which is disposed within the horizontal plane that is spanned by the transverse axis and by the longitudinal axis. The separating wall can divide the region that is surrounded by the protective wall (in which the one or more contact pins are disposed) into two parts, in particular into two halves of the same size. Furthermore, the separating wall can be connected to the protective wall in the region of the guide groove, in particular in such a manner that the guide groove that is formed by the protective wall is supported by the separating wall along the transverse axis. In this manner, it is possible to further increase the stability of the coupling system.

In accordance with a further aspect, a further first coupling element for a coupling system is described. The features of a first coupling element described in this document can also be used for this first coupling element in each case individually or in combination.

The first coupling element includes a tubular connecting piece, which protrudes in relation to the contact surface of the first coupling element along the longitudinal axis, and which is configured so as to be inserted into the tubular receiving region of the second coupling element of the coupling system, which extends, starting from the contact surface of the second coupling element, along the longitudinal axis into the housing of the second coupling element.

The first coupling element includes at least one first plug-in unit which is disposed along the transverse axis next to the connecting piece and which is configured so as to form an electrically conductive plug-in connection with the second plug-in unit of the second coupling element, wherein the second plug-in unit of the second coupling element is disposed along the transverse axis next to the receiving region.

The connecting piece of the first coupling element has a guide contour that is disposed on the outer wall of the connecting piece and that faces the first plug-in unit. The guide contour of the first coupling element is configured so as to interact with a complementary guide contour of the second coupling element in such a manner that the guide contours block a rotation of the first coupling element relative to the second coupling element about the longitudinal axis.

In accordance with a further aspect, a second coupling element for a coupling system is described. The features of a second coupling element described in this document can also be used for this second coupling element in each case individually or in combination.

The second coupling element includes a tubular receiving region for a connecting piece of a first coupling element of the coupling system, which extends, starting from the contact surface of the second coupling element, along the longitudinal axis into the housing of the second coupling element, wherein the tubular connecting piece of the first coupling element protrudes in relation to a contact surface of the first coupling element along the longitudinal axis.

The second coupling element further includes a second plug-in unit which is disposed along the transverse axis next to the receiving region and which is configured so as to form an electrically conductive plug-in connection with the first plug-in unit of the first coupling element, wherein the first plug-in unit of the first coupling element is disposed along the transverse axis next to the connecting piece.

In addition, the second coupling element has a guide contour that is configured so as to be complementary to the guide contour on the connecting piece of the first coupling element and that faces the second plug-in unit. The guide contour of the second coupling element is configured so as to interact with the guide contour of the first coupling element in such a manner that the guide contours block a rotation of the first coupling element relative to the second coupling element about the longitudinal axis.

In accordance with a further aspect, a further coupling system is described for connecting different suction air-guiding components of a suction apparatus. It should be noted that the features described in this document (in particular the features described above) of a coupling system can also be used in each case individually or in combination for this coupling system.

As already explained, the coupling system includes a first coupling element having a tubular connecting piece, which protrudes in relation to the contact surface of the first coupling element along the longitudinal axis, and a second coupling element having a tubular receiving region for the connecting piece of the first coupling element, which extends, starting from the contact surface of the second coupling element, along the longitudinal axis into the housing of the second coupling element.

The first coupling element includes at least one first plug-in unit which is disposed along the transverse axis next to the connecting piece, wherein the first plug-in unit has a recess having a wall which extends, starting from the contact surface of the first coupling element, along the longitudinal axis into the housing of the first coupling element.

The second coupling element includes at least one second plug-in unit which is disposed along the transverse axis next to the receiving region and which is configured so as to form an electrically conductive plug-in connection with the first plug-in unit of the first coupling element.

The first coupling unit preferably has in each case a first plug-in unit along the transverse axis on both sides of the connecting piece, and the second coupling unit preferably has in each case a second plug-in unit along the transverse axis on both sides of the receiving region.

The connecting piece of the first coupling element has a guide contour, wherein the guide contour on the connecting piece of the first coupling element extends along the longitudinal axis into the recess. The guide contour on the connecting piece of the first coupling element can extend along the longitudinal axis, starting from the contact surface of the first coupling element, by 1 mm or more, in particular by 2 mm or more, into the recess of the first plug-in unit of the first coupling element. The guide contour on the connecting piece of the first coupling element can have a total length (for example, of 6 cm or more) along the longitudinal axis. The guide contour on the connecting piece of the first coupling element can extend along the longitudinal axis, starting from the contact surface of the first coupling element, by 1% or more, in particular by 2% or more, of the total length into the recess of the first plug-in unit of the first coupling element.

The second coupling element has a guide contour that is complementary to the guide contour on the connecting piece of the first coupling element.

The connecting piece of the first coupling element preferably has in each case a guide contour along the transverse axis on both sides of the connecting piece, wherein the guide contours on the connecting piece of the first coupling element in each case extend along the longitudinal axis into the recess of the respective first plug-in unit of the first coupling element. The second coupling element can have in each case a guide contour that is in each case complementary thereto along the transverse axis on both sides of the receiving region.

The guide contours can be configured so as to interact in such a manner that the guide contours block a rotation of the first coupling element relative to the second coupling element about the longitudinal axis.

A coupling system is thus described, which includes a first coupling element having a first plug-in unit, which has a recess, wherein the recess can be used to provide a plug-in connection to the corresponding second plug-in unit of the second coupling element, and wherein the recess is also used to provide a particularly long guide contour, in particular a particularly long guide rib. In this manner, it is possible to provide a particularly stable and compact coupling system.

As explained above, the guide contour of the first coupling element can include a guide rib that is disposed on the outer wall of the connecting piece and that extends along the longitudinal axis into the recess of the first plug-in unit of the first coupling element. The guide contour of the second coupling element can include a guide groove that is complementary thereto and that extends along the longitudinal axis.

The second plug-in unit of the second coupling element can have a protective wall which protrudes in relation to the contact surface of the second coupling element along the longitudinal axis (and which can preferably be plugged into the recess of the first plug-in unit). The guide contour, in particular the guide groove, of the second coupling element can extend, starting at the protective wall of the second plug-in unit, along the longitudinal axis into the receiving region. In this manner, the region in which the guide contours interact along the longitudinal axis can be further extended in order to further increase the stability and the compactness of the coupling system.

The first plug-in unit of the first coupling element and the second plug-in unit of the second coupling element can in each case intersect the horizontal plane that is spanned by the transverse axis and by the longitudinal axis (and can be symmetrically identical in relation to the horizontal plane). Furthermore, the guide contours of the first coupling element and of the second coupling element can in each case intersect the horizontal plane (and can be symmetrically identical in relation thereto). In this manner, the stability and compactness of the coupling system can be further improved.

In accordance with a further aspect, a first coupling element for a coupling system is described. The features of a first coupling element described in this document can also be used for this first coupling element in each case individually or in combination.

The first coupling element includes a tubular connecting piece, which protrudes in relation to the contact surface of the first coupling element along the longitudinal axis, and which is configured so as to be inserted into a tubular receiving region of the second coupling element of the coupling system, which extends, starting from the contact surface of the second coupling element, along the longitudinal axis into the housing of the second coupling element.

The first coupling element includes at least one first plug-in unit which is disposed along the transverse axis next to the connecting piece and which is configured so as to form an electrically conductive plug-in connection with the second plug-in unit of the second coupling element, wherein the second plug-in unit of the second coupling element is disposed along the transverse axis next to the receiving region. The first plug-in unit has a recess having a wall that extends, starting from the contact surface of the first coupling element, along the longitudinal axis into the housing of the first coupling element.

The connecting piece of the first coupling element has a guide contour that is disposed on the outer wall of the connecting piece and that faces the first plug-in unit. The guide contour on the connecting piece of the first coupling element extends along the longitudinal axis into the recess of the first plug-in unit of the first coupling element.

In accordance with a further aspect, a second coupling element for a coupling system is described. The features of a second coupling element described in this document can also be used for this second coupling element in each case individually or in combination.

The second coupling element includes a tubular receiving region for a connecting piece of the first coupling element of the coupling system, which extends, starting from the contact surface of the second coupling element, along the longitudinal axis into the housing of the second coupling element, wherein the tubular connecting piece of the first coupling element protrudes in relation to a contact surface of the first coupling element along the longitudinal axis.

The second coupling element includes a second plug-in unit which is disposed along the transverse axis next to the receiving arrangement and which is configured so as to form an electrically conductive plug-in connection with the first plug-in unit of the first coupling element, wherein the first plug-in unit of the first coupling element is disposed along the transverse axis next to the connecting piece, and wherein the first plug-in unit has a recess having a wall, which extends along the longitudinal axis starting from the contact surface of the first coupling element into the housing of the first coupling element.

The second coupling element has a guide contour which is configured so as to be complementary to the guide contour on the connecting piece of the first coupling element, wherein the guide contour on the connecting piece of the first coupling element extends along the longitudinal axis into the recess of the first plug-in unit of the first coupling element.

With the objects of the invention in view, there is additionally provided, in accordance with a further aspect, a suction air-guiding component (for example, a suction unit, a suction tube and/or a nozzle) for a suction apparatus, wherein the component comprises a first coupling element and/or a second coupling element.

With the objects of the invention in view, there is concomitantly provided, in accordance with a further aspect, a suction apparatus, in particular a hand-guided vacuum cleaner, which comprises the coupling system described in this document.

It should be noted that any aspects of the coupling system described in this document and the suction apparatus described in this document can be combined with one another in a variety of ways. In particular, the features of the claims can be combined with one another in a variety of ways.

Other features which are considered as characteristic for the invention are set forth in the appended claims.

Although the invention is illustrated and described herein as embodied in a coupling system for a suction apparatus having mutually oriented electrical plug-in units and guide contours, coupling elements, a suction air-guiding component and a suction apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

As explained at the beginning, the present document deals with causing a stable, reliable and convenient mechanical and electrical connection between different components of a suction apparatus.

Figure 1A:
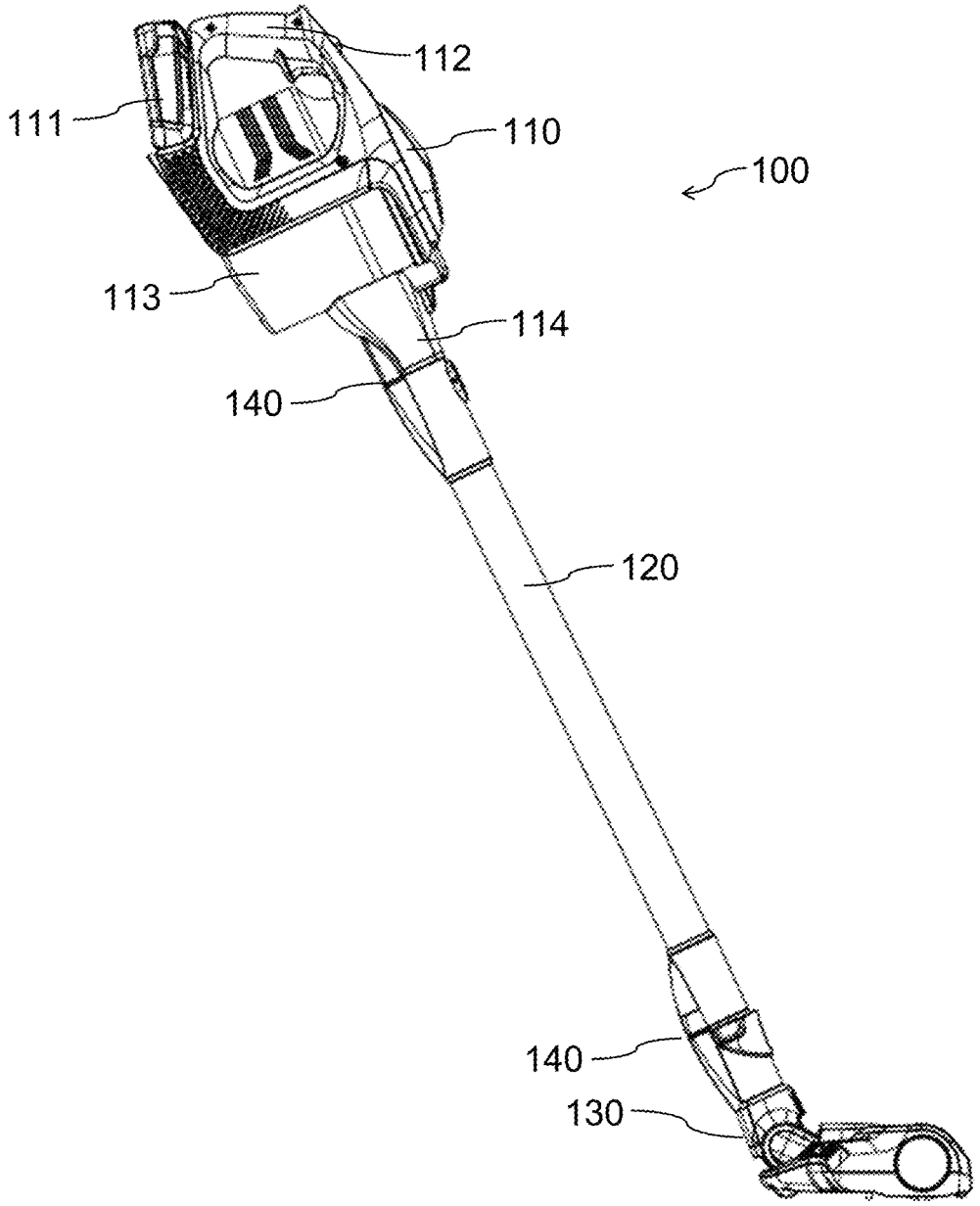
FIG. 1*a* is a diagrammatic, perspective view of an exemplary suction apparatus having a suction unit, a suction tube and a nozzle.

Referring now to the figures of the drawings in detail and first, particularly, to FIG. 1 thereof, there is seen, in this context, an exemplary (hand-held) vacuum cleaner 100 (as an example of a suction apparatus), which has a suction unit 110 with an electrical energy storage device 111. The suction unit 110 has a handle 112 that can be gripped by a user with one hand in order to hold the suction unit 110. The fan of the suction unit 110 causes a suction air flow through the suction mouth 114 of the suction unit 110, via a separating unit 113 of the suction unit 110, to the fan. The suction unit 110 can be configured so as to be used independently as a suction apparatus.

An accessory 120, 130 can be connected to the suction unit 110 via a coupling system 140. In the illustrated example, the suction unit 110 is connected via a coupling system 140 to a suction tube 120, which in turn is connected via a coupling system 140 to a floor nozzle 130.

Figure 1B:
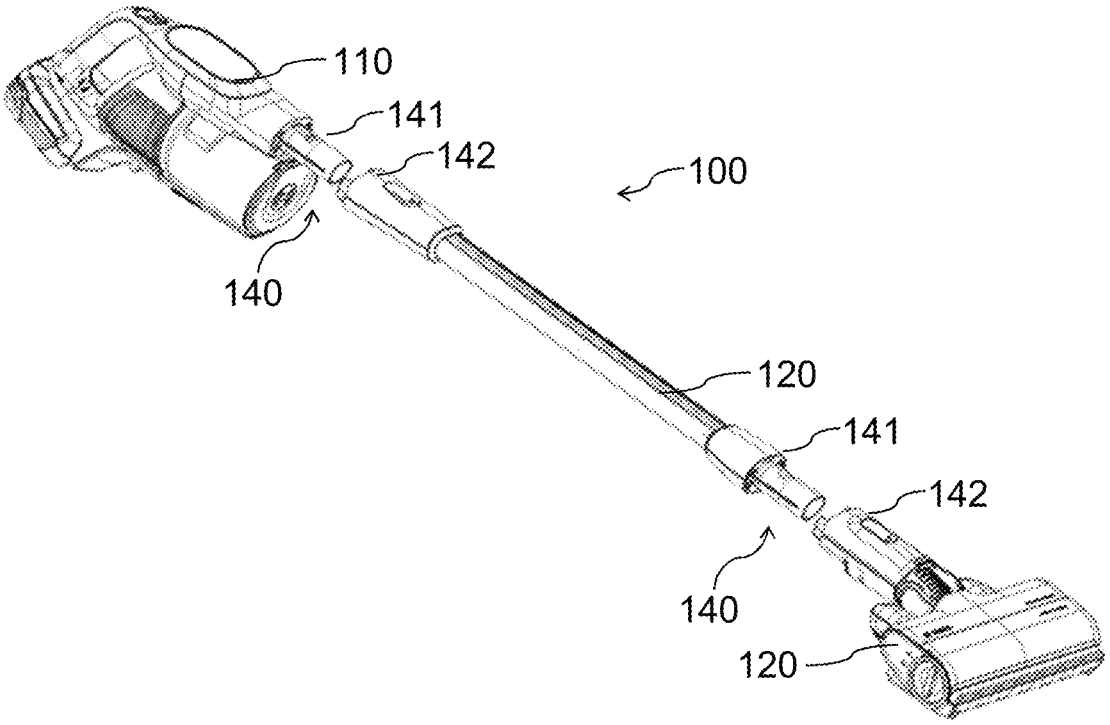
FIG. 1*b* is a view similar to FIG. 1*a* showing further details of a coupling system for a suction apparatus.

As is apparent in FIG. 1*b*, the coupling system 140 includes a first coupling element 141, which is disposed on a first component of the suction apparatus 100, and a second coupling element 142, which is disposed on a second component of the suction apparatus 100. With regard to the flow direction of the suction air flow, the first coupling element 141 follows the second coupling element 142. The suction air flow thus first passes the second coupling element 142 and then the first coupling element 141. The first coupling element 141 and the second coupling element 142 are preferably configured in a complementary manner in such a manner that the two coupling elements 141, 142 form a plug-in system and can thus be plugged together.

Figure 2A:
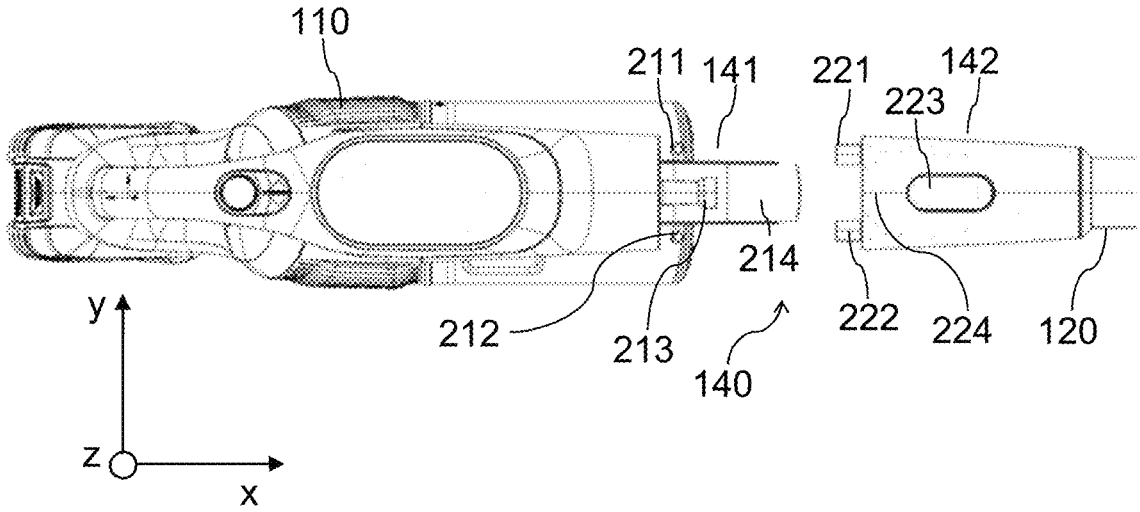
FIGS. 2*a* to 2*b* are exploded plan and perspective views of a coupling system for a suction apparatus.
Figure 2B:
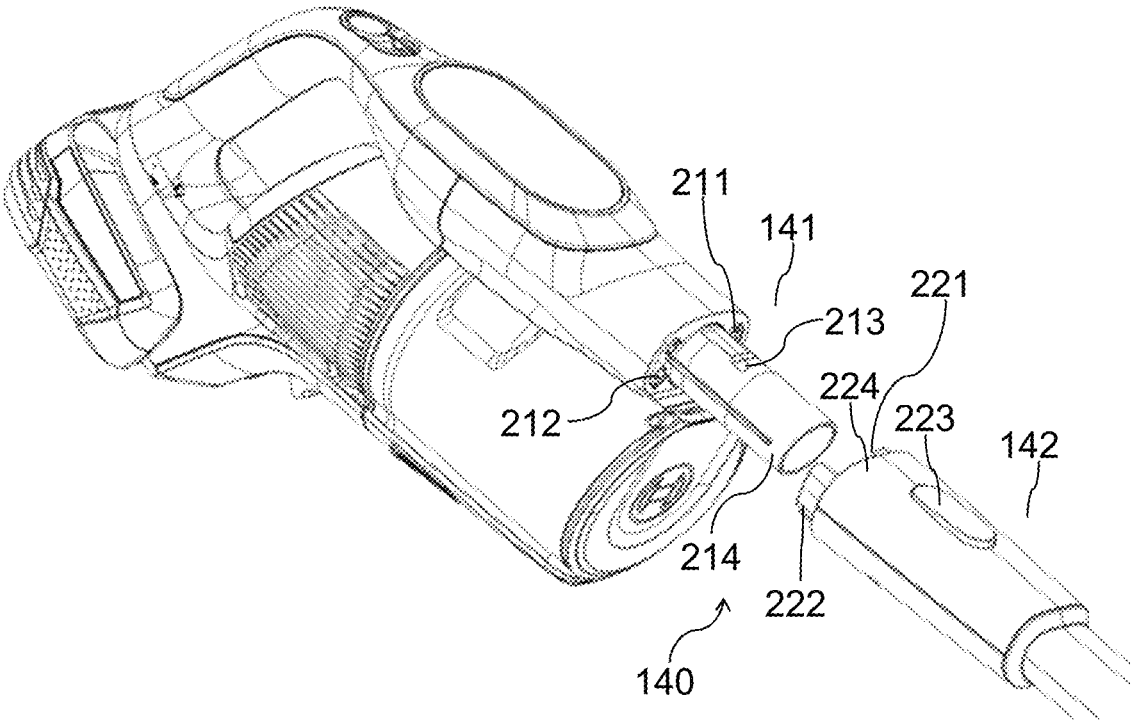
Figure 3A:
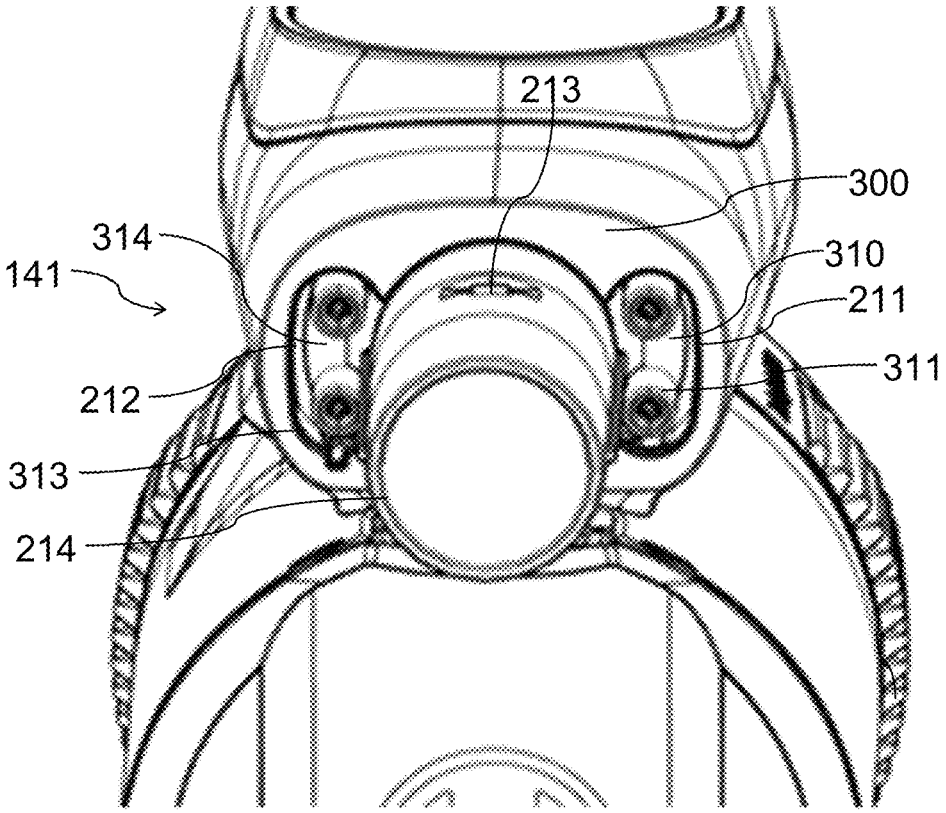
FIGS. 3*a* to 3*e* are perspective and plan views of a first coupling unit of a coupling system.
Figure 3B:
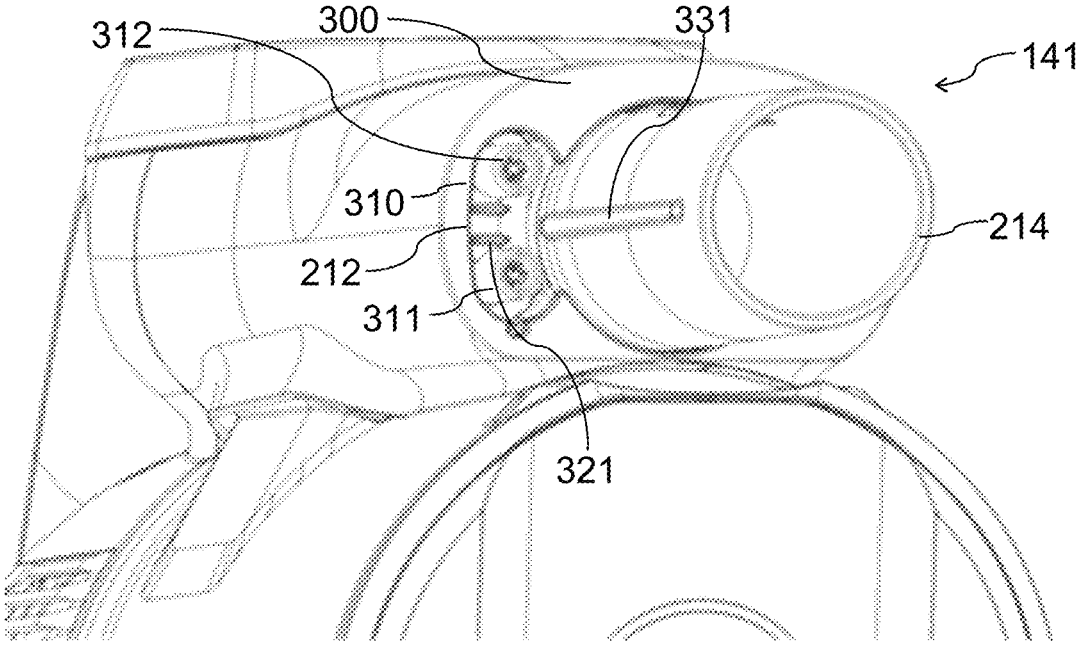
Figure 3C:
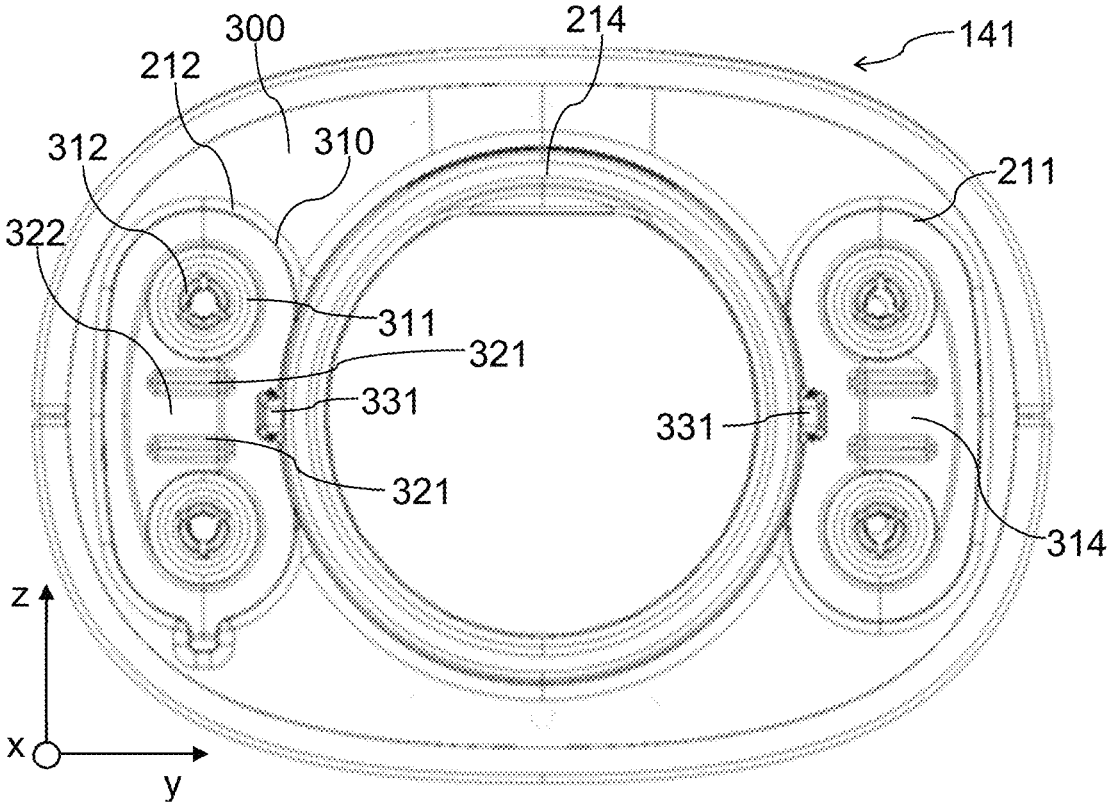
Figure 3D:
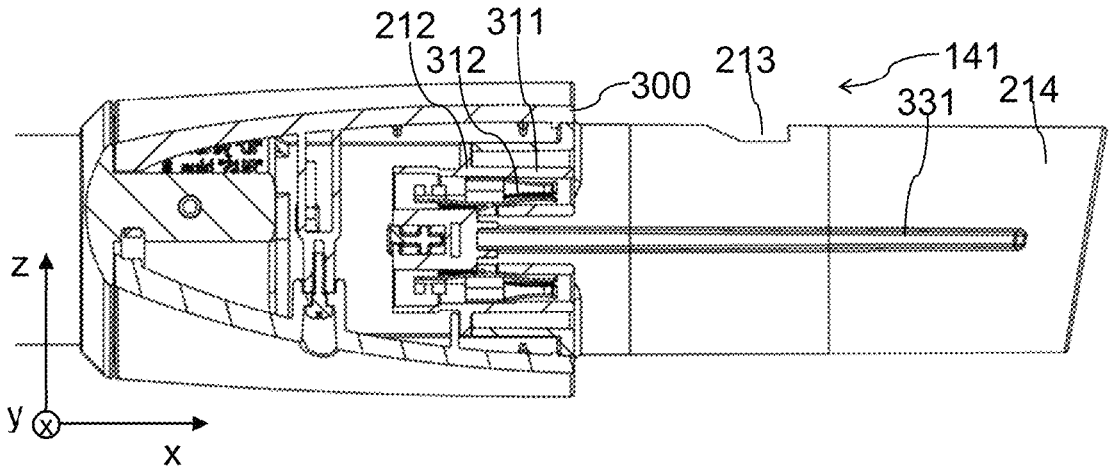
Figure 3E:
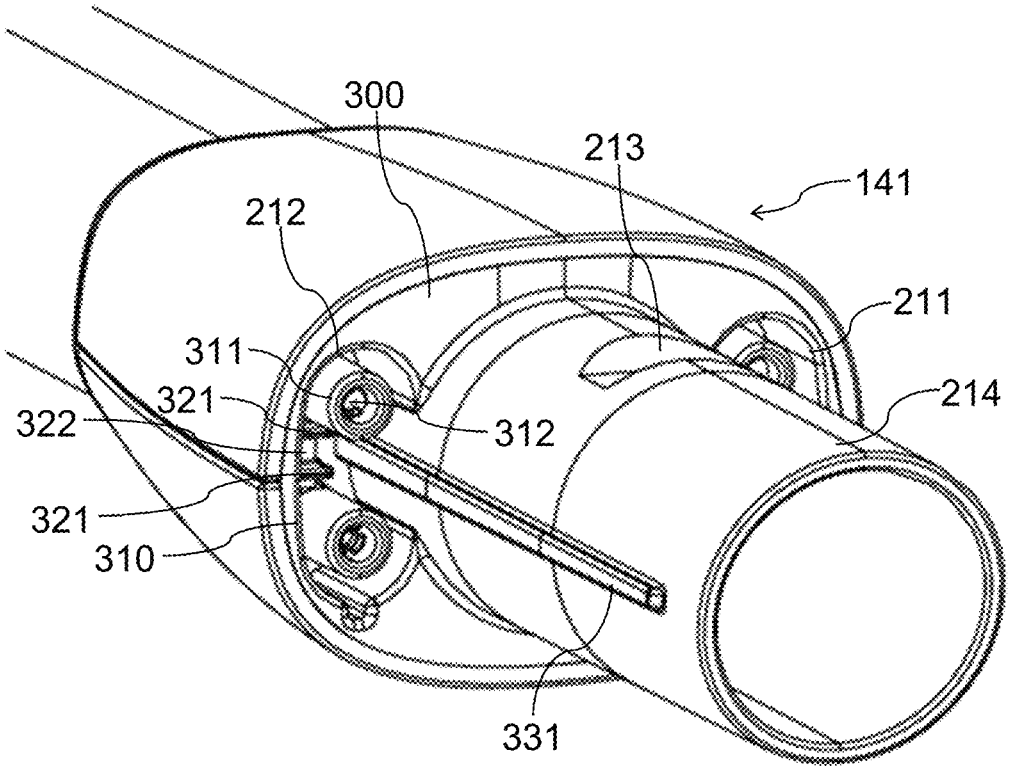

FIGS. 2*a* and 2*b* illustrate different views of the coupling system 140. Further, FIG. 2*a* illustrates a Cartesian coordinate system that defines different axes of the coupling system 140. The coupling system 140 has a longitudinal axis (i.e. the x axis that is illustrated in FIG. 2*a*) that runs in parallel to the flow direction of the suction air flow. In addition, the coupling system 140 has a transverse axis (i.e. the y axis that is illustrated in FIG. 2*a*) that runs between the left-hand side and the right-hand side of the coupling system 140. In addition, the coupling system 140 includes a vertical axis (i.e., the z-axis that is illustrated in FIG. 2*a*) that runs between the underside and the upper side of the coupling system 140. It should be noted that the terms "left-hand side," "right-hand side," "bottom" and "top" refer to the respective axis, and that the use of the terms is based on the assumption that the coupling system 140 is oriented in such a manner that the transverse axis runs horizontally, that the vertical axis runs vertically, and/or that the flow direction runs away from the observer.

The first coupling element 141 includes a connecting piece 214 which is configured as a male plug-in part of a tube connection. The second coupling element 142 includes a complementary receiving region 224 as a female plug-in part of the tube connection. On the upper side of the outer wall of the connecting piece 214, a notch 213 can be disposed in which the hook of a fixing element 223 of the second coupling element 142 can engage in order to form a latching connection between the two plug-in parts, i.e. the connecting piece 214 of the first coupling element 141 and the receiving region 224 of the second coupling element 142. In this manner, a relative movement of the first coupling element 141 and the second coupling element 142 along the longitudinal axis can be prevented.

The first coupling element 141 further has a jack 211 which is configured so as to form an electrically conductive plug-in connection with a plug-in connector 221 of the second coupling element 142. In addition, in the example illustrated, the first coupling element 141 has a further jack 212 which is configured so as to form an electrically conductive plug-in connection with a further plug-in connector 222 of the second coupling element 142. The coupling system 140 can thus be configured so as to provide two electrically conductive plug-in connections. In this case, a plug-in connection for the transmission of electrical energy for the operation of one or more electrical actuators, in particular motors, can be configured and/or used. The other plug-in connection can be configured and/or used for the transmission of data for the control of the one or more actuators. The first electrically conductive plug-in connection (with the jack 211 and the plug-in connector 221) is disposed to the right-hand side of the tube connection (with the connecting piece 214 and the recess region 224). The second electrically conductive plug-in connection (with the jack 212 and the plug-in connector 222) is disposed to the left-hand side of the tube connection (with the connecting piece 214 and the recess region 224).

It should be noted that the jack 211 is an example of a first plug-in unit of the first coupling element 141, and that the plug-in connector 211 is an example of a second plug-in unit of the second coupling element 142.

FIGS. 3*a* to 3*e* illustrate further details of the first coupling element 141, and FIGS. 4*a* to 4*d* illustrate further details of the second coupling element 142. The first coupling element 141 has a planar contact surface 300 which is oriented perpendicularly to the longitudinal axis and which preferably runs within the plane that is spanned by the transverse axis and the vertical axis. In the coupled state of the coupling system 140, the contact surface 300 bears against a corresponding contact surface 400 of the second coupling element 142, as a result of which a wobbling movement (perpendicular to the longitudinal axis and/or around the transverse axis) is hindered.

The one or more jacks 211, 212 (i.e. the one or more first plug-in units) of the first coupling element 141 in each case have a depression 310 that starts from the contact surface 300 and is surrounded by a wall 313. The recess 310 forms a basin that is delimited by the wall 313. One or more, in particular two, hollow-cylindrical contact bolts 311 extend from the base 314 of the recess 310, into which a complementary contact pin 422 of a plug-in connector 221, 222 (i.e. a second plug-in unit) of the second contact element 142 can be inserted in each case in order to provide an electrically conductive connection in each case. For this purpose, the individual contact bolts 311 in each case have an electrically conductive (hollow cylindrical) contact surface 312.

In the example shown, a jack 211, 212 (i.e. a first plug-in unit) in each case has a first contact bolt 311 and a second contact bolt 311, which are disposed one behind the other or one above the other along the vertical axis (for example, for a positive and for a negative electrical potential).

The recess 310 of a jack 211, 212 (i.e. a first plug-in unit) preferably has a depth along the longitudinal axis of 0.5 cm or more, in particular of 1 cm or more.

The one or more plug-in connectors 221, 222 (i.e. the one or more second plug-in units) are configured in a complementary manner to the corresponding one or more jacks 211, 212 (i.e. the one or more first plug-in units). A plug-in connector 221, 222 (i.e. a second plug-in unit) has a protective wall 410 that extends away from the contact surface 400 of the second coupling element 142 along the longitudinal axis. The protective wall 410 preferably has a length along the longitudinal axis that is configured in such a manner that the end face of the protective wall 410 that faces the first coupling element 141 (at least almost) contacts the base 314 of the corresponding jack 211, 212 (i.e. the corresponding first plug-in unit) when the contact surfaces 300, 400 of the two coupling elements 141, 142 contact one another.

A plug-in connector 211, 212 (i.e. a second plug-in unit) furthermore in each case has one or more electrically conductive contact pins 422, which in each case extend away from the contact surface 400 of the second coupling element 142 along the longitudinal axis within the free space surrounded by the protective wall 410. In the example shown, a plug-in connector 211, 212 (i.e. a second plug-in unit) in each case has two contact pins 422, which are disposed one behind the other or one above the other along the vertical axis. The individual contact pins 422 preferably have a length along the longitudinal axis that is smaller than the length of the protective wall 410. In this manner, the individual contact pins 422 can be reliably protected against mechanical effects.

A separating wall 412, which is preferably disposed perpendicularly to the vertical axis and/or within the plane spanned by the longitudinal axis and by the transverse axis, runs between the two contact pins 422. The protective wall 410 surrounding the contact pins 422 can be mechanically supported and thus stabilized by the separating wall 412.

A jack 211, 212 (i.e. a first plug-in unit) preferably has two clamping elements 321 on the base 314 of the recess 310, which in each case extend parallel to the transverse axis and which are disposed between the two contact bolts 311 of the jack 211, 212. A receiving arrangement 322 for receiving the end face of the separating wall 412 is formed between the two clamping elements 321. The separating wall 412 is thus clamped between the two clamping elements 321 when the two coupling elements 141, 142 are plugged together. In this manner, a particularly stable mechanical connection can be formed between the two coupling elements 141, 142.

Figure 4A:
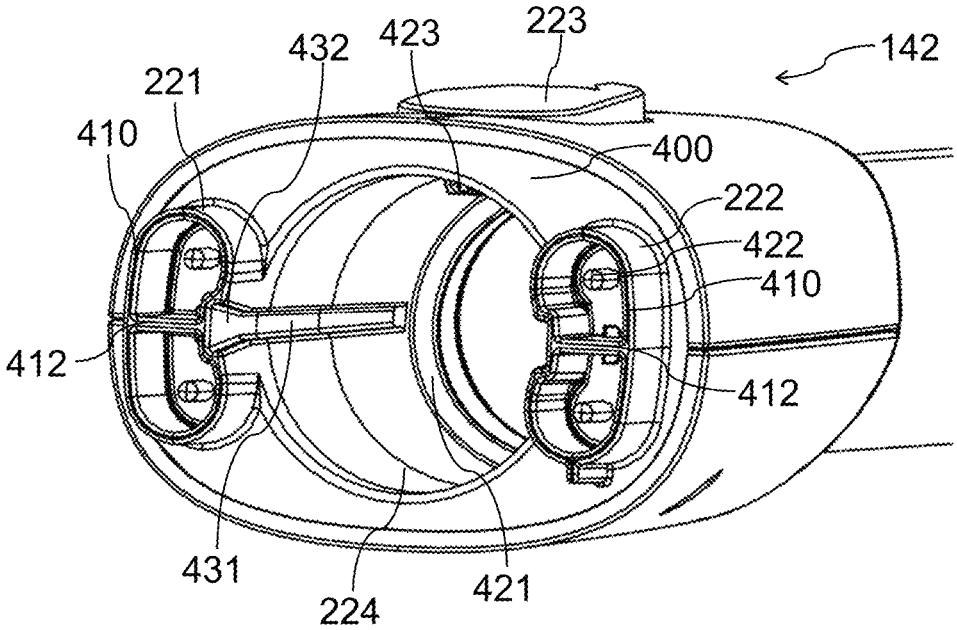
FIGS. 4*a* to 4*d* are perspective, plan and longitudinal-sectional views of a second coupling unit of a coupling system.
Figure 4B:
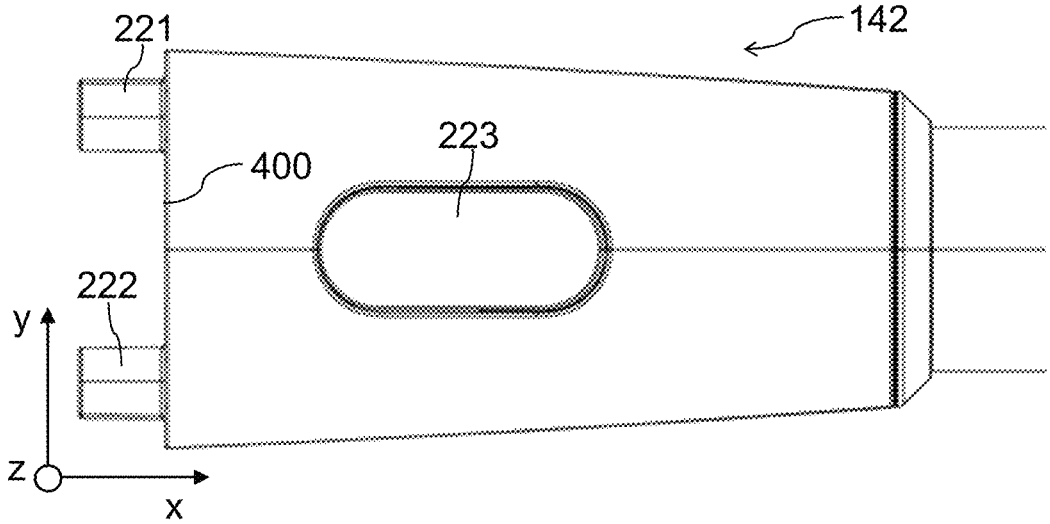
Figure 4C:
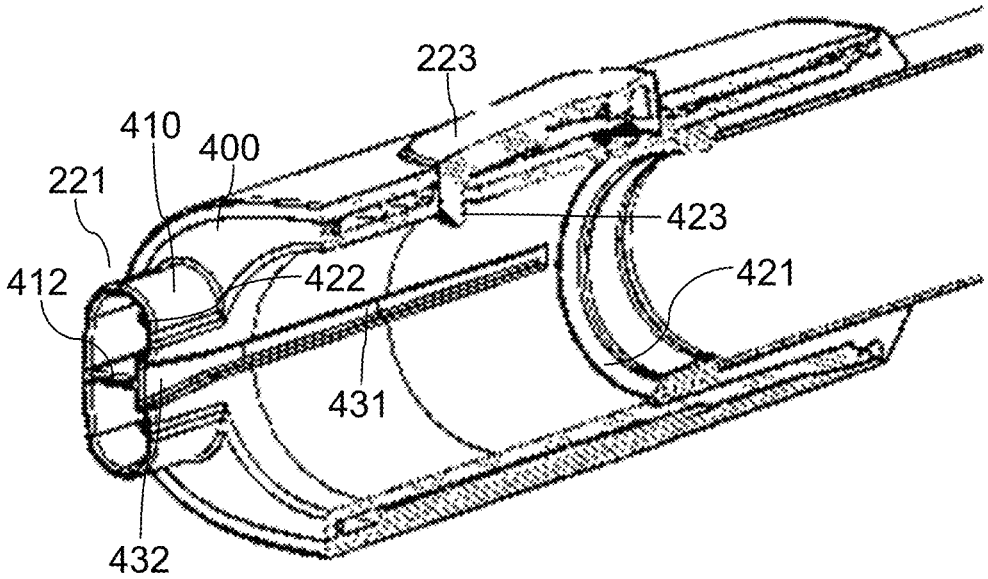
Figure 4D:
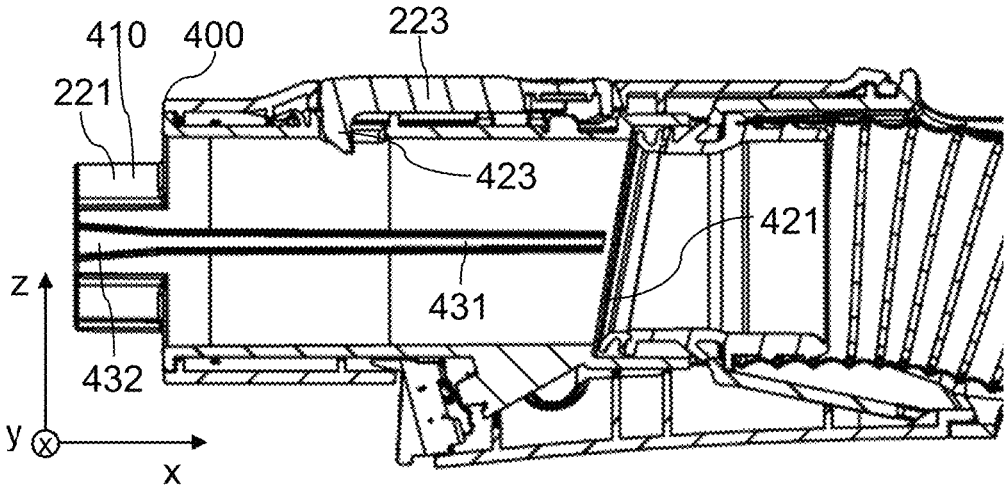

FIG. 4*a* illustrates the hook 423 of the fixing element 223 of the second coupling element 142, wherein the hook 423 is configured so as to engage in the notch 213 on the connecting piece 214 of the first coupling element 141 in order to fix the plug-in connection between the two coupling elements 141, 142 along the longitudinal axis.

The recess region 224 of the second coupling element 142 preferably has a depth, starting from the contact surface 400 of the second coupling element 142, along the longitudinal axis that corresponds to the length of the connecting piece 214 (starting from the contact surface 300 of the first coupling element 141). Furthermore, the recess region 224 preferably has a bearing ring 421 on which the end face of the connecting piece 214 that faces the second coupling element 142 bears when the two coupling elements 141, 142 are connected to one another (i.e. plugged together). In this manner, turbulence of the suction air flow within the coupling system 140 can be reliably avoided.

As can be seen in particular from FIG. 4*a*, the second coupling element 142 has a guide groove 431 (generally a guide contour) that extends along the longitudinal axis on the inner wall of the recess region 224 into the recess region 224. The guide groove 431 begins at the end face of the protective wall 410 of a plug-in connector 221, 222 (i.e. a second plug-in unit) of the second coupling element 142. This enables the two coupling elements 141, 142 to be oriented in the correct manner with respect to one another already at the beginning of a plug-in procedure process.

The guide groove 431 is preferably disposed in a plane with the separating wall 412 between the two contact pins 411 of a plug-in connector 221, 222 (i.e. a second plug-in unit). The separating wall 412 can thus be used to stabilize the guide groove 431 in the region of the plug-in connector 221, 222 (i.e. the second plug-in unit). In this manner, a deformation of the guide groove 431 at the beginning of a plugging process can be reliably avoided.

The guide groove 431 can have a threading region 432 on the input side (i.e. on the protective wall 410 of the plug-in connector 221, 222), in which the guide groove 431 is widened (along the vertical axis). In this manner, the corresponding guide rib 331 (generally the corresponding guide contour) on the outer wall of the connecting piece 214 of the first coupling element 141 can be introduced into the guide groove 431 in a particularly reliable and convenient manner at the beginning of a plug-in procedure.

The second coupling element 142 preferably has a first guide groove 431 on the first plug-in connector or unit 221 and a second guide groove 431 on the second plug-in connector or unit 222. A guide groove 431 can thus be disposed on the left-hand side and on the right-hand side of the recess region 224 in each case. In a corresponding manner, the first coupling element 141 can have a first (left-hand side) guide rib 331 and a second (right-hand side) guide rib 331, which are each disposed on the outer wall of the connecting piece 214 and which each extend away from the contact surface 300 along the longitudinal axis. The two guide ribs 331 can be pushed into the respective corresponding guide groove 431 during a plug-in procedure along the longitudinal axis. In this manner, the two coupling elements 141, 142 can be connected to one another in a defined manner directly from the beginning of the plug-in procedure.

Due to the fact that the one or more guide grooves 431 already begin at the end face of the protective wall 410 of the one or more plug-in connectors 221, 222 (i.e. the one or more second plug-in units) (and preferably extend as far as the bearing or stop ring 421 in the recess region 224 of the second coupling element 142), the length of the individual guide grooves 431 can be increased, which has a positive effect on the stability and in particular on the rigidity of the mechanical connection between the two coupling elements 141, 142. In particular, wobbling movements about the transverse axis can be reliably impeded and in particular prevented.

It should be noted that a guide groove 431 and a guide rib 331 are examples of mechanically interacting guide contours.

Figure 5A:
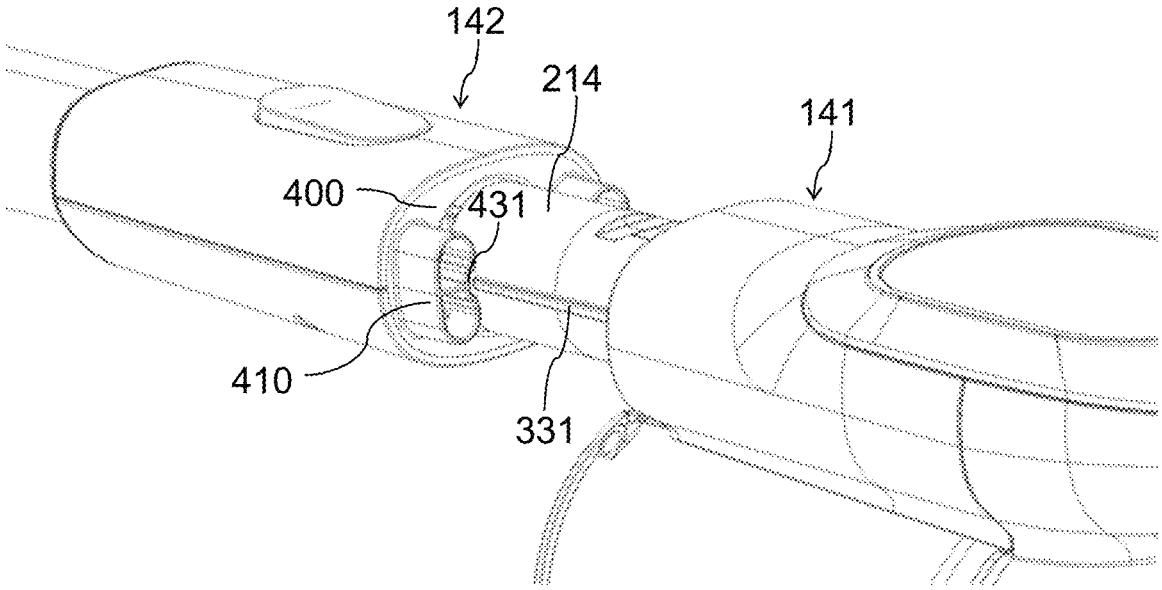
FIGS. 5*a* to 5*d* are perspective and plan views showing different states of a coupling system.

FIG. 5*a* illustrates by way of example how at the beginning of a plug-in procedure a guide rib 331 of the first coupling element 141 is threaded into the guide groove 431 on the protective wall 410 of a plug-in connector 221, 222 of the second coupling element 142.

Figure 5B:
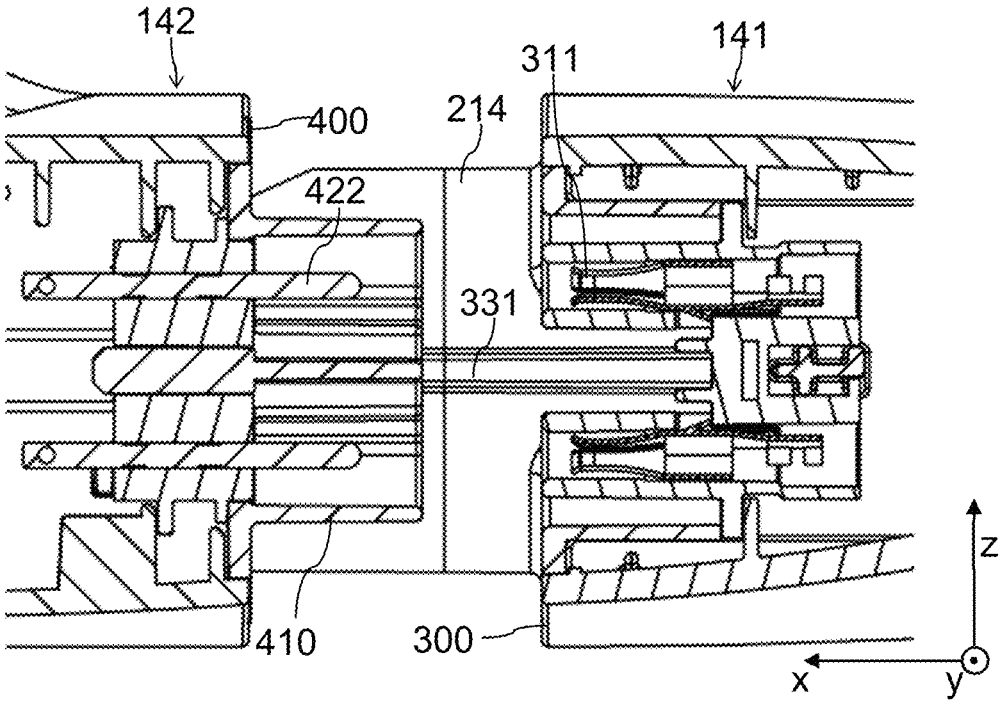
Figure 5C:
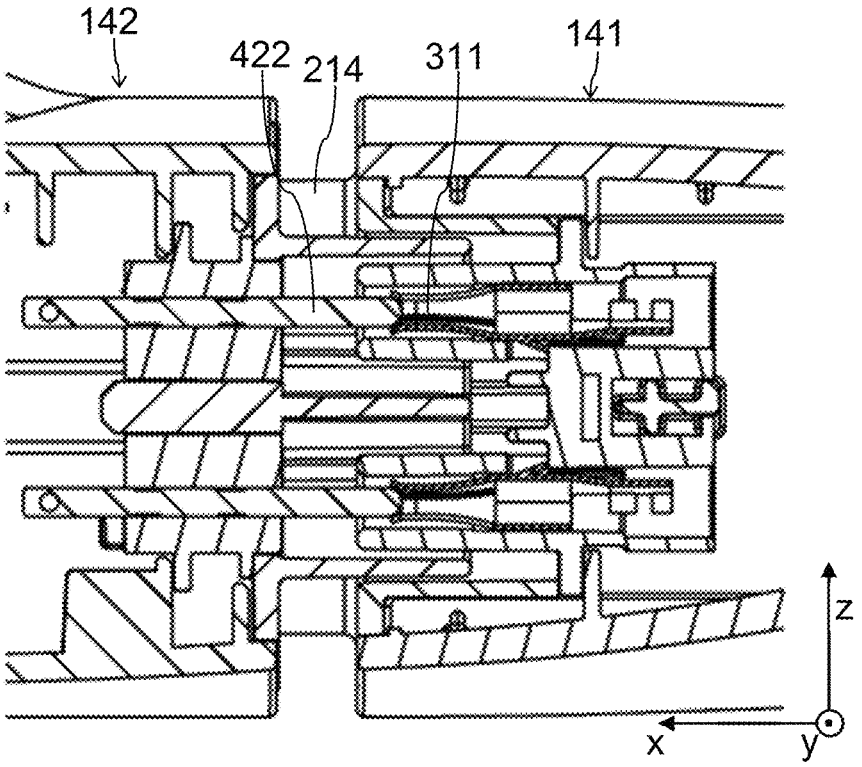
Figure 5D:
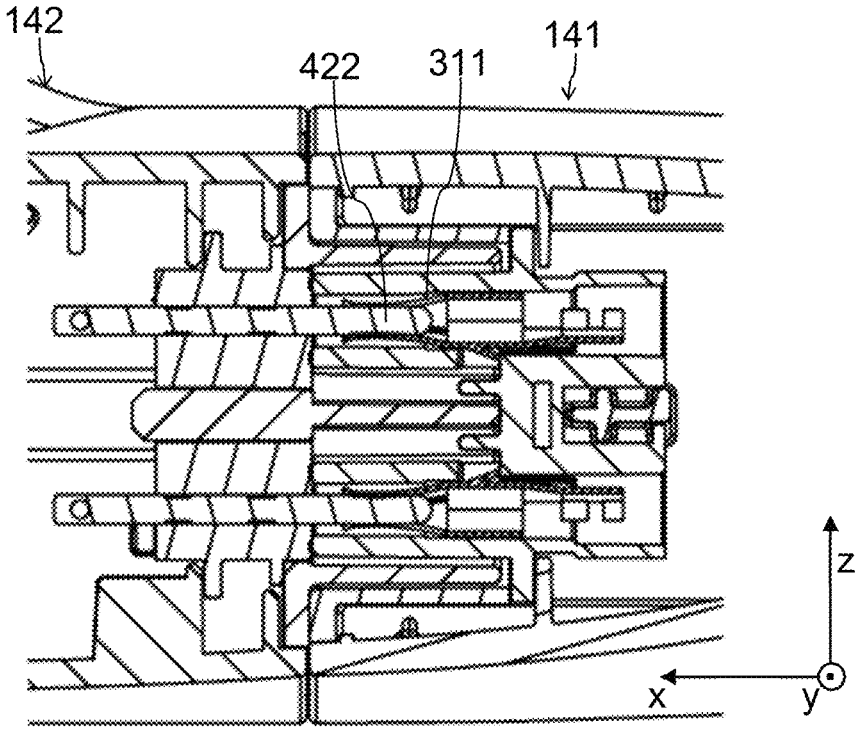

FIGS. 5*b* to 5*d* illustrate different states of a plug-in procedure. In particular, it can be seen from FIGS. 5*b* to 5*d* how the contact pins 422 are moved little by little along the longitudinal axis onto the corresponding contact bolts 311, and finally in each case form an electrically conductive connection.

The protective wall 410 of the one or more plugs 221, 222 is preferably configured as a single piece with the contact surface 400 and/or the housing of the second coupling element 142, wherein the recess region 224 for the connecting piece 214 of the first coupling element 141 is formed by the housing of the second coupling element 142.

The two guide grooves 431 and/or the two guide ribs 331 can be configured geometrically differently in order to provide a mechanical coding, through the use of which a rotation of the plug-in connection, for example a rotation by 180° about the longitudinal axis, is reliably avoided. A guide rib 331 can thus be configured as a coding rib.

Alternatively or additionally, the two plugs 221, 222 or jacks 211, 212 can be configured geometrically differently (in particular in relation to the protective wall 410 or the wall 313) in order to avoid twisting of the plug-in connection.

The one or more guide ribs 331 can be set back from the end face of the connecting piece 214 along the longitudinal axis. The one or more guide ribs 331 can be set back along the longitudinal axis by a distance from the end face of the connecting piece 214 that corresponds (approximately) to the length of the protective wall 410 of the one or more plug-in connectors 221, 222. In this manner, the end face of the connecting piece 214 can be disposed on the contact surface 400 of the second coupling element 142 when the beginning of the guide rib 331 is disposed on the threading region 432 of the corresponding guide groove 431. It is thus possible to particularly conveniently and reliably plug together the coupling elements 141, 142.

A guide rib 331 and a corresponding guide groove 431 are preferably configured so as to form a tongue-and-groove connection. In this case, the tongue-and-groove connection does not end at the locating surface 300, 400 of the coupling elements 141, 142, but is extended (along the longitudinal axis) over the depth of the one or more plugs 221, 222. In this manner, a particularly stable mechanical connection between the coupling elements 141, 142 can be achieved. In particular, forces and torques that are introduced into the connection between the connecting piece 214 and the receiving region 224 can be better absorbed by the extended tongue-and-groove connection.

By providing a plurality of jacks 211, 212 or plug-in connectors 221, 222, power and data lines can be spatially separated from one another, as a result of which the interference resistance is increased.

By providing a mechanical coding, it is possible to prevent incorrect assembly of the coupling system 140.

A tube connection (i.e. a coupling system 140) is thus described for connecting different suction air-guiding components 110, 120, 130 of a suction apparatus 100. The second (possibly female) plug part 142 (i.e. the second coupling element) includes a tubular receiving region 224 for a first (possibly male) plug part 141 (i.e. for the connecting piece 214 of the first coupling element 141). The front side of the receiving region 224 can have a locating and/or contact surface 400 for the first plug part 141 (i.e. for the first coupling element 141).

The second plug-in part 142 (i.e. the second coupling element 142) includes at least one electrical contact (in particular at least one contact pin 422), wherein the electrical contact is surrounded by a spaced-apart protective wall 410 that is closed in an annular manner at least in sections.

The second plug part 142 has a form-locking guide contour 431 (for a tongue-and-groove connection) in the tubular receiving region 224 for receiving a corresponding guide contour 331 on the first plug-in part 141, wherein the guide contour 431 is configured to absorb forces and/or torques.

The protective wall 410 of the at least one electrical contact can have at least one section that protrudes in relation to the locating surface and/or contact surface 400 of the second plug-in part 142. This section can be an extension of the tubular receiving region 224. Furthermore, the contour 431 can extend as far as the section that protrudes in relation to the locating surface and/or contact surface 400 of the second plug-in part 142.

The at least one electrical contact (i.e. the contact pin 422) is preferably set back from the front surface (i.e. the end face) of the protective wall 410 in order to provide particularly reliable mechanical protection.

A (mechanical) coding can be disposed on the protective wall 410, which prevents the two plug-in parts 141, 142 (i.e. the two coupling elements) from being incorrectly plugged together, in particular a plugging together of the two plug-in parts 141, 142 rotated by 180° about the longitudinal axis. In this manner, the reliability of the coupling system 140 can be further increased.

As already explained, the contour 431 can have an insertion chamfer 432 in order to enable a plugging together procedure that is as reliable and convenient as possible.

In particular, in the case of a plurality of electrical contacts (i.e. contact pins 422), the protective wall 410 preferably has a separating wall 412, through the use of which the mechanical stability of the protective wall 410 and/or the contour 431 can be further increased.

The second plug part 142 (i.e. the second coupling element) preferably has two protective walls 410 that lie opposite one another on both sides and in each case protrude. In this manner, the mechanical stability of the coupling system 140 can be further increased.

The present invention is not limited to the illustrated exemplary embodiments. In particular, it should be noted that the description and the figures are intended to illustrate only the principle of the coupling system 140 and/or the suction apparatus 100.

The following is a summary list of reference numerals and the corresponding structure used in the above description of the invention:

| | |
|---|---|
| 100 | Suction apparatus (suction wiper) |
| 110 | Suction unit |
| 111 | Electrical energy storage device |
| 112 | Handle |
| 113 | Separating unit |
| 114 | Suction mouth |
| 120 | Accessory (suction tube) |
| 130 | Accessory (nozzle) |
| 140 | Contact system |
| 141 | First contact element |
| 142 | Second contact element |
| 211, 212 | Jack (first plug-in unit) |
| 213 | Notch |
| 214 | (Tubular) connecting piece |
| 221, 222 | Plug (second plug-in unit) |
| 223 | Fixing element |
| 224 | (Tubular) receiving region |
| 300 | Contact surface |
| 310 | Recess (reservoir) |
| 311 | Contact bolt |
| 312 | Contact surface |
| 313 | Wall (recess) |
| 314 | Base (recess) |
| 321 | Clamping element |
| 322 | Receiving arrangement (Separating wall) |
| 331 | (Guide) rib (guide contour) |
| 400 | Contact surface |
| 410 | Protective wall |
| 412 | Separating wall |
| 421 | Stop ring (connecting piece) |
| 422 | Contact pin |
| 423 | Hook |
| 431 | (Guide) groove (guide contour) |
| 432 | Threading region |

The invention claimed is:

1. A coupling system for connecting different suction air-guiding components of a suction apparatus, the coupling system comprising:

a first coupling element having a contact surface and a tubular connecting piece protruding relative to said contact surface of said first coupling element along a longitudinal axis;

a second coupling element having a housing, a contact surface and a tubular receiving region for said tubular connecting piece of said first coupling element, said tubular receiving region starting from said contact surface of said second coupling element and extending along said longitudinal axis into said housing of said second coupling element;

said first coupling element including at least one first plug-in unit disposed along a transverse axis next to said tubular connecting piece;

said second coupling element including at least one second plug-in unit disposed along said transverse axis next to said tubular receiving region, said at least one second plug-in unit configured to form an electrically conductive plug-in connection with said at least one first plug-in unit of said first coupling element;

said tubular connecting piece of said first coupling element having a guide contour facing said at least one first plug-in unit;

said second coupling element having a guide contour facing said at least one second plug-in unit, said guide contour of said second coupling element being complementary to said guide contour of said tubular connecting piece;

said guide contours configured to interact with each other to block a rotation of said first coupling element relative to said second coupling element about the longitudinal axis;

said at least one first plug-in unit of said first coupling element and said at least one second plug-in unit of said second coupling element intersecting a horizontal plane spanned by said transverse axis and by said longitudinal axis;

said at least one first plug-in unit having two contact bolts disposed spaced apart along a vertical axis;

said at least one second plug-in unit having two contact pins disposed spaced apart along said vertical axis for contacting said two contact bolts of said at least one first plug-in unit;

one of said contact bolts of said at least one first plug-in unit and a corresponding one of said contact pins of said at least one second plug-in unit being disposed on an upper side of said horizontal plane; and a further one of said contact bolts of said at least one first plug-in unit and a corresponding further one of said contact pins of said at least one second plug-in unit being disposed on an underside of said horizontal plane being opposite to said upper side; and said at least one second plug-in unit of said second coupling element having a protective wall protruding relative to said contact surface of said second coupling element along said longitudinal axis, said protective wall surrounding said two contact pins of said at least one second plug-in unit; and said at least one first plug-in unit of said first coupling element including two first plug-in units each being disposed along said transverse axis on a respective side of said tubular connecting piece;

said at least one second plug-in unit of said second coupling element including two second plug-in units each being disposed along said transverse axis on a respective side of said tubular receiving region;

said two first plug-in units and said two second plug-in units forming pairs of an electrically conductive plug-in connection;

said guide contour of said tubular connecting piece of said first coupling element being one of two guide contours each disposed along said transverse axis on a respective side of said tubular connecting piece;

said guide contour of said second coupling element being one of two complementary guide contours each disposed along said transverse axis on a respective side of said tubular receiving region; and said guide contours being configured in pairs to interact and block a rotation of said first coupling element relative to said second coupling element about said longitudinal axis.

2. The coupling system according to claim 1, wherein:

said two first plug-in units of said first coupling element and said two second plug-in units of said second coupling element intersect said horizontal plane; and said two guide contours of said first coupling element on both sides of said tubular connecting piece and said two guide contours of said second coupling element on both sides of said tubular receiving region intersect said horizontal plane.

3. The coupling system according to claim 2, wherein:

said two first plug-in units of said first coupling element and said two second plug-in units of said second coupling element are configured in a symmetrically identical manner relative to said horizontal plane; and said two guide contours of said first coupling element on both sides of said tubular connecting piece and said two guide contours of said second coupling element on both sides of said tubular receiving region are configured in a symmetrically identical manner relative to said horizontal plane.

4. The coupling system according to claim 1, wherein:

said guide contour of said second coupling element includes a guide groove running in said protective wall of said at least one second plug-in unit and extending along said longitudinal axis.

5. The coupling system according to claim 4, wherein said guide groove is disposed centrally on said protective wall along said vertical axis.

6. The coupling system according to claim 1, wherein:

said at least one second plug-in unit of said second coupling element has a separating wall being disposed within said horizontal plane and spanned by said transverse axis and by said longitudinal axis;

said separating wall divides a region surrounded by said protective wall into two parts; and said separating wall is connected to said protective wall in a region of said guide groove.

7. The coupling system according to claim 6, wherein said two parts are two equal-size halves of said region surrounded by said protective wall, and said guide groove formed by said protective wall is supported by said separating wall along said transverse axis.

* * * * *